US009945151B2

(12) United States Patent
Giacomini et al.

(10) Patent No.: US 9,945,151 B2
(45) Date of Patent: Apr. 17, 2018

(54) INVISIBLE HANDLE LOCKING SYSTEM

(71) Applicant: Whirlpool Corporation, Benton Harbor, MI (US)

(72) Inventors: Neomar Giacomini, St. Joseph, MI (US); Axel Julio Ramm, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 13 days.

(21) Appl. No.: 14/965,048

(22) Filed: Dec. 10, 2015

(65) Prior Publication Data

US 2017/0167163 A1 Jun. 15, 2017

(51) Int. Cl.
*E05B 1/00* (2006.01)
*F25D 23/02* (2006.01)

(52) U.S. Cl.
CPC ..... *E05B 1/0015* (2013.01); *F25D 23/028* (2013.01)

(58) Field of Classification Search
CPC ..... Y10T 16/459; E05B 31/0015
See application file for complete search history.

(56) References Cited

U.S. PATENT DOCUMENTS 2,239,798 A * 4/1941 Tinnerman ..... A47B 95/00 16/422
2,870,493 A * 1/1959 Beyrle ..... E05B 1/0015 16/402
3,017,657 A * 1/1962 Mills ..... E05B 1/0015 16/413
4,404,709 A * 9/1983 Janz ..... B60N 3/026 16/422
5,144,718 A * 9/1992 Ozawa ..... E05B 1/0015 16/412
5,758,454 A * 6/1998 Trap ..... E05B 79/06 49/460
5,906,423 A * 5/1999 Lyu ..... F25D 17/047 220/231
6,030,064 A * 2/2000 Kim ..... E05D 7/0423 16/271
6,375,291 B1 * 4/2002 Nam ..... E05B 17/0033 16/412
6,594,861 B2 * 7/2003 Dimig ..... E05B 79/06 16/412
7,197,792 B2 * 4/2007 Moon ..... E05B 1/0015 16/412
7,263,744 B2 9/2007 Kim et al.
7,640,630 B2 * 1/2010 Lee ..... F25D 23/028 16/413
7,793,388 B2 * 9/2010 Wing ..... E05B 1/0015 16/412

(Continued)

FOREIGN PATENT DOCUMENTS

CA 2588294 A1 11/2007
CN 201047190 4/2008

(Continued)

*Primary Examiner* — Jerry E Redman
*Assistant Examiner* — Catherine A Kelly
(74) *Attorney, Agent, or Firm* — Price Heneveld LLP

(57) ABSTRACT

A refrigerator door includes a handle that is secured to the door utilizing connectors at first and second ends of the handle. The connectors do not have exposed screws, thereby improving the appearance of the refrigerator door.

17 Claims, 3 Drawing Sheets

(56) References Cited

U.S. PATENT DOCUMENTS

| | | | | |
|---|---|---|---|---|
| 8,857,867 | B2 * | 10/2014 | Saitou | E05B 79/06 292/336.3 |
| 9,009,969 | B2 * | 4/2015 | Choi | F25D 23/028 16/412 |
| 9,366,471 | B2 * | 6/2016 | Allen | E05B 1/0015 |
| 9,470,022 | B2 * | 10/2016 | Lange | E05B 85/10 |
| 2006/0143865 | A1 * | 7/2006 | Magyar | A47B 95/02 16/412 |

FOREIGN PATENT DOCUMENTS

| | | | | |
|---|---|---|---|---|
| CN | 203036989 | | 7/2013 | |
| DE | 2124236 | A1 * | 11/1972 | E05B 85/10 |
| EP | 1058072 | A1 | 6/2000 | |
| JP | 2103392 | A | 4/1990 | |

* cited by examiner

Fig. 2
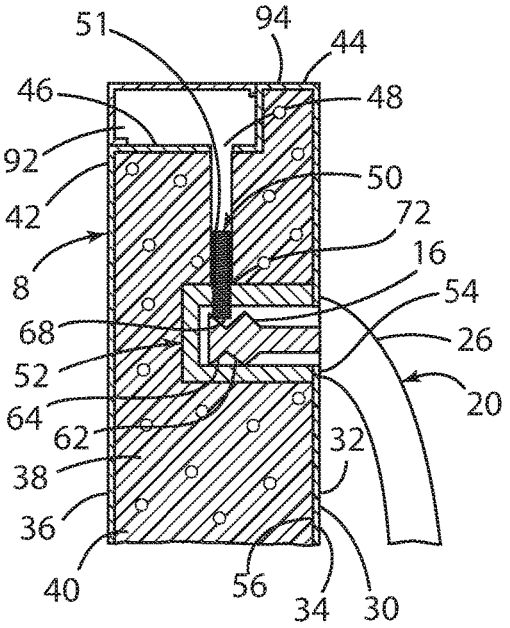
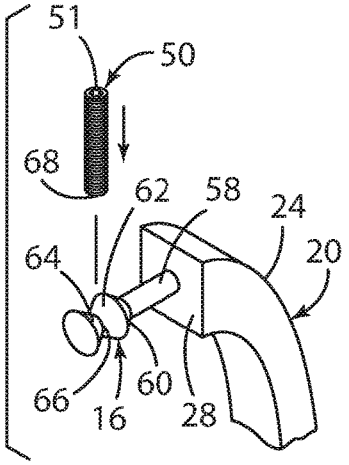
Fig. 3
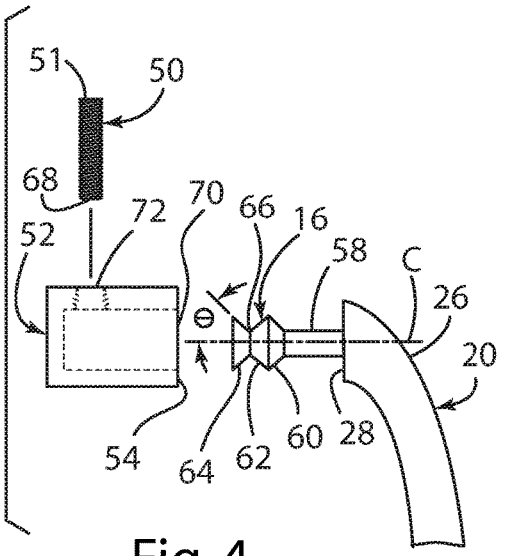
Fig. 4
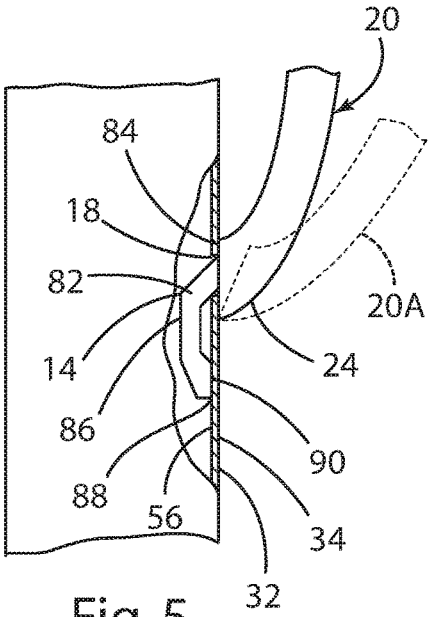
Fig. 5

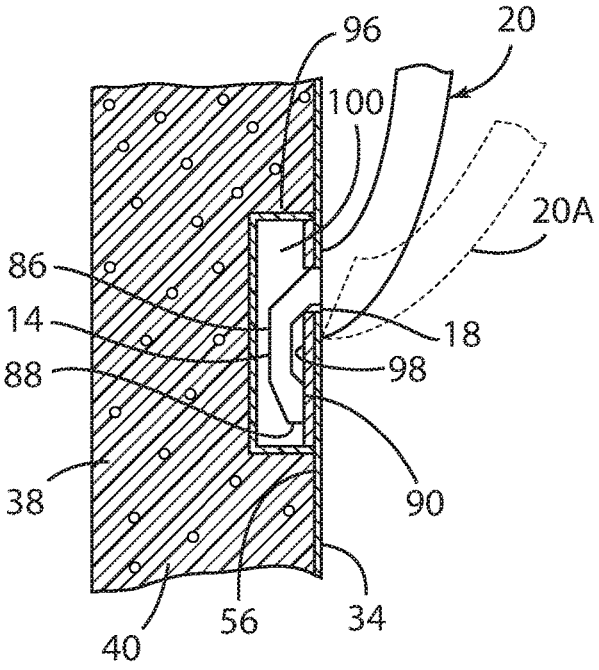
Fig. 6
Fig. 7
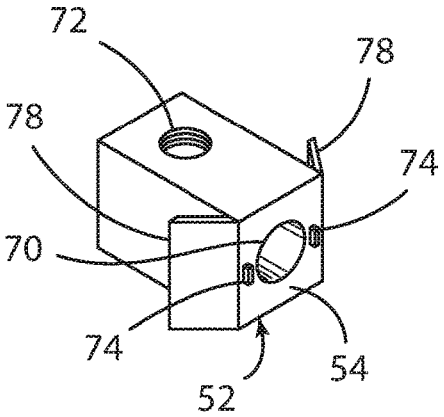
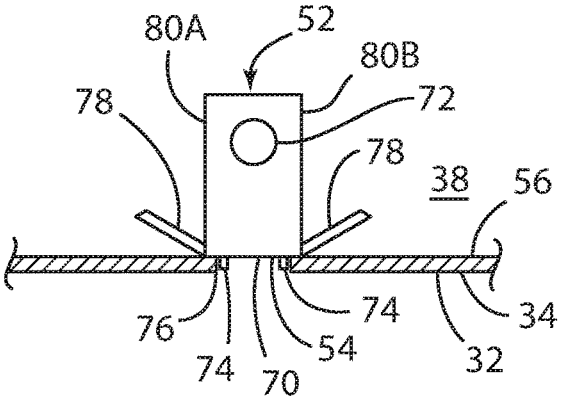
Fig. 8

INVISIBLE HANDLE LOCKING SYSTEM

BACKGROUND OF THE INVENTION

Refrigerators typically include one or more doors having handles that are attached to the doors. The doors may be attached by screws or other types of fasteners. However, known door attachment arrangements may suffer from various drawbacks.

SUMMARY OF THE INVENTION

One aspect of the present invention is a method of assembling a handle to a refrigerator door. The method includes providing a refrigerator door having a liner and a front sheet that is spaced from the liner to define an interior space. The door includes an outwardly facing edge surface extending transversely from the front sheet. The edge surface has a first opening. The edge surface may be formed in a door cap, and the edge surface may face upwardly. The front sheet has an inner surface facing the interior space, and an oppositely facing outer surface. The outer surface may comprise an upright outer surface of the refrigerator door. The front sheet includes second and third openings through the front sheet. The method includes providing a locking member having first and second connectors. The first connector may comprise a threaded opening, and the second connector may comprise a channel or bore that extends and connects to the threaded opening. The method includes positioning the locking member in the interior space with the first connector in registry with the first opening, and the second connector in registry with the second opening. The locking member may be adhesively secured to the inner surface of the front sheet. The method further includes providing a handle having first and second opposite ends. The first end has a first insert portion, and the second end has a second insert portion. The first insert portion of the handle is inserted into the third opening in the front sheet, and the second insert portion is inserted into the second opening in the front sheet, and the second insert portion engages the second connector of the locking member. A fastener is inserted through the first opening in the edge surface, and the fastener engages the first connector of the locking member and the second insert portion of the handle to thereby secure the second insert portion of the handle to the locking member to retain the handle in an installed position on the refrigerator door. The locking member may include a protrusion that is positioned in the first opening to align the first connector with the first opening. The interior space of the refrigerator door may be filled with foam insulation that at least partially encapsulates the locking member.

These and other features, advantages, and objects of the present invention will be further understood and appreciated by those skilled in the art by reference to the following specification, claims, and appended drawings.

BRIEF DESCRIPTION OF THE DRAWINGS

FIG. 2 is a partially fragmentary enlarged view of the upper end of the door handle of FIG. 1 showing attachment thereof to the refrigerator door;

FIG. 3 is a partially fragmentary isometric view of the upper end of the handle of FIGS. 1 and 2;

FIG. 4 is an exploded view of the upper end of the door handle, locking member, and locking screw;

FIG. 5 is a partially fragmentary, enlarged view of a lower portion of the handle of FIG. 1 showing the attachment of the lower end of the handle to the refrigerator door;

FIG. 6 is an enlarged view of another embodiment in which the door includes a housing and a reinforcing plate at the lower end of the handle;

FIG. 7 is an isometric view of the locking member;

FIG. 8 is a partially fragmentary view of the locking member taken along the line VII-VII; FIG. 1.

DETAILED DESCRIPTION

Figure 1:
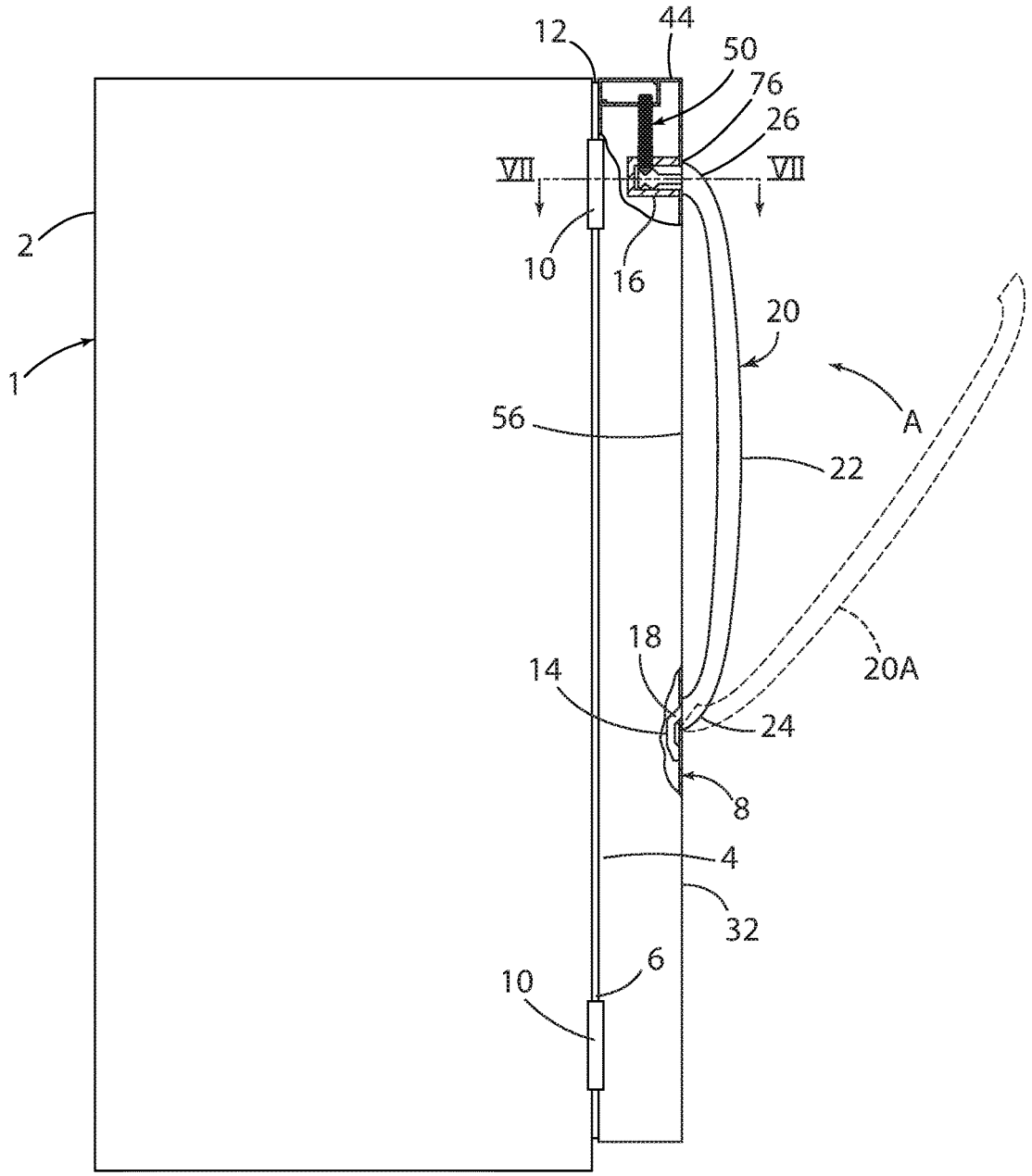
FIG. 1 is a partially fragmentary side elevational view of a refrigerator and refrigerator door showing a door handle according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a refrigerator 1 according to one aspect of the present invention includes an insulated cabinet 2 having one or more openings 4 on a front side 6 of the cabinet 2. A door 8 is movably mounted to the cabinet 2 by one or more hinges 10 whereby the door 8 rotates about a vertical axis relative to the cabinet 2 to selectively close off the openings 4. A gasket 12 attached to the refrigerator door 8 extends around the opening 4 when door 8 is in a closed position to seal the opening 4.

A door handle 20 is secured to the refrigerator door 8 utilizing an attachment configuration/method that does not result in screws that are visible to a user. Handle 20 includes an elongated main portion 22, a first or lower end 24, and a second or upper end 26. First or lower end 24 of handle 20 has a first insertion portion or protrusion 14, and the second or upper end 26 includes a second insertion portion or protrusion 16.

With further reference to FIGS. 2-4, upper end 24 of handle 20 includes an end surface 28 that contacts an outer surface 30 of a front side 32 of door 8. Front or outer surface 30 of door 8 may be formed by a front sheet of material 34 of door 8. Door 8 may include an inner member such as liner 36 that is spaced apart from front sheet 34 to form an interior space or cavity 38 that may be filled with foam 40 during the assembly process as described in more detail below. The front sheet 34 may comprise polymer or metal, and the inner liner 36 preferably comprises a polymer material. A top cap 42 extends along the upper edge 44 of door 8, and includes an outwardly and upwardly facing surface 46 that extends transversely relative to the front side 32 of door 8 and outer surface 30 of door 8. Top cap 42 includes an opening 48 that receives a threaded fastener such as set screw 50 having a hex socket 51. As discussed in more detail below, a locking member 52 is disposed inside door 8, and includes threaded opening 72 that receives set screw 50. Locking member 52 also has a front surface 54 that may be adhesively secured to an inner surface 56 of front sheet 34 of door 8 when assembled.

With reference to FIG. 3, the second protrusion 16 includes a base portion 58 that extends from end surface 28, and first, second, and third conical surface portions 60, 62, and 64, respectively. The conical surface portions 62 and 64 define a recess or annular groove 66 that is engaged by end 68 of set screw 50 when the handle 20 is assembled to the refrigerator door 8. End 68 of set screw 50 preferably comprises a flat, oval, cup, or dog end (not conical), and opening 48 may be configured/positioned such that end 68 of set screw 50 only contacts conical surface 64, thereby generating a force pulling surface 28 of handle 20 into contact with outer surface 30 of door 8. Surface 64 is preferably at an angle θ (FIG. 4) of about 45-70 degrees relative to centerline "C" of protrusion 16. However it will be understood that the present invention is not limited to any specific angle. Also, it will be understood that the protrusion 16 may have a square or rectangular cross sectional shape, and surfaces 60, 62, and 64 may be flat. Thus, the present invention is not limited to the specific configuration shown in FIG. 3.

With further reference to FIGS. 7 and 8, locking member 52 includes a bore or opening 70, and a threaded opening 72 that extends transverse to the opening or bore 70 and intersects therewith. When assembled, protrusion 16 of handle 20 is inserted into opening 70, and screw 50 is inserted into threaded opening 72. The screw 50 is tightened to thereby engage the end 68 of screw 50 with the sloped surface 64 of recess or groove 66 of protrusion 16. Screw 50 may engage surfaces 62 and 64 (FIG. 4), only surface 62, or only surface 64.

Locking member 52 includes protrusions 74 that are received in an opening 76 in front sheet 34 of door 8 when locking member 52 is assembled with the front sheet 34. The protrusions 74 ensure that the opening 70 of locking member 52 is aligned with opening 76 in front sheet 34. The locking member 52 preferably includes a pair of arms or flaps 78 that extend outwardly and inwardly from opposite sides 80A and 80B of locking member 52. The flaps or arms 72 are encapsulated or embedded in foam 40 to thereby hold the locking member 52 in place within interior space or cavity 38 of door 8.

With reference to FIG. 5, first insertion portion or protrusion 14 at lower end 24 of handle 20 is generally in the form of a hook, and includes a base portion 82 that extends transversely from an end surface 84 of handle 20. The protrusion 14 further includes a central portion 86 that extends generally downwardly, parallel to the front side 32 of door 8. An end portion 88 of protrusion 14 includes a surface 90 that faces inner surface 56 of front sheet 34 when handle 20 is installed on door 8. When assembled, the surface 90 may abut or contact inner surface 56. Alternatively, the surface 90 of handle 20 may be spaced inwardly from inner surface 56 of front sheet 34 to define a gap.

With reference to FIG. 6, a housing 96 and reinforcing plate 98 may be secured to inner surface 56 of front sheet 34 by adhesive or the like prior to injecting foam 40 into interior space or cavity 38. Reinforcing plate 98 is preferably made of a rigid material (e.g. steel or other metal), to ensure that end surface 90 of protrusion 14 of handle 20 does not cause front sheet 34 to deform outwardly. Housing 96 may be made of polymer or other suitable material, and is generally box-shaped to seal off foam 40 during injection of liquid foam 40 prior to curing to thereby prevent the foam 40 from escaping through opening 18 in sheet 34 and to ensure that foam 40 does not fill space 100 in a manner that could otherwise interfere with insertion of end portion 14 of handle 20.

Referring again to FIG. 1, during assembly of door 8 the locking member 52 is adhered to inner surface 56 of front sheet 32. The protrusions 74 of locking member 52 (FIG. 7) are positioned in opening 76 in front sheet 34. Adhesive material is utilized to adhesively bond the locking member 52 to the front sheet 34. The front sheet 34 and inner liner 36 are then connected to one another utilizing known techniques, and door top cap 42 is also attached to the front sheet 34 and liner 36 utilizing adhesives or other suitable techniques. A rod or the like (not shown) may then be inserted through opening 48 in top cap 42, with an end of the rod extending downwardly into threaded opening 72 of locking member 52. The rod may be removed after foam 40 (FIG. 2) is foamed in place to form a bore/opening that receives set screw 50. Alternatively, the set screw 50 may be inserted through opening 48 in top cap 42, and the set screw 50 may be threadably engaged with threaded opening 72 of locking member 52.

Polyurethane foam 40 (FIG. 2) or other suitable material is then injected into the interior space or cavity 38 of door 8. The foam 40 surrounds and encapsulates the locking member 52, and the foam 40 secures the locking member 52 in place upon curing of the foam 40. As discussed above, the foam 40 preferably encapsulates the flaps or arms 78 to retain the locking member 52 in place. The screw 50 can then be at least partially removed to permit insertion of protrusion 16 of handle 20 into the opening 70 of locking member 52.

To connect the handle 20 to door 8, the protrusion 14 at lower end 24 of handle 20 is first inserted into opening 18 (see also FIG. 5) with the handle 20 in an outwardly rotated position designated "20A" in FIG. 1. The handle 20 is then rotated upwardly and inwardly as designated by the arrow "A," and the protrusion 16 at upper end 26 of handle 20 is inserted into opening or bore 70 in locking member 52. The set screw 50 is then tightened, thereby causing end 68 of set screw 50 to engage surface 64 of recess or groove 66 of protrusion 16, thereby securely interconnecting the upper end 26 of handle 20 to the refrigerator door 8.

Because screw 50 is positioned along the upper edge 44 of door 8, the screw 50 is not visible by a user. The screw 50 is preferably disposed in a recess 92 (FIG. 2) that is lower than upper surface 94 of top cap 42, thereby ensuring that the screw 50 is hidden.

The handle 20 may be assembled to the refrigerator door during assembly of refrigerator 1 at a factory or other such production facility. Alternatively, the handle 20 may be initially disconnected from the door 8, and the handle 20 may be assembled to the door 8 after shipping the refrigerator 1 to a retailer. Still further, the handle 20 may be installed to door 8 at the time the refrigerator is installed in a house, building, or other such facility.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A method of assembling a handle to a refrigerator door, the method comprising:

providing a refrigerator door having a liner and a front sheet that is spaced from the liner to define an interior space, the door including an outwardly facing edge surface extending transversely from the front sheet, the edge surface having a first opening, the front sheet having an inner surface facing the interior space, an oppositely facing outer surface, and second and third openings through the front sheet;

providing a fastener having an end portion;

providing a handle having first and second opposite ends, the first end having a first insert portion, the second end having a second insert portion;

providing a locking member having a first connector that is configured to engage the end portion of the fastener, and a second connector that is configured to engage the second insert portion of the handle;

positioning the locking member in the interior space with the first connector in registry with the first opening, and with the second connector simultaneously in registry with the second opening;

inserting the first insert portion of the handle into the third opening in the front sheet, inserting the second insert portion into the second opening in the front sheet and engaging the second insert portion with the second connector of the locking member;

inserting the fastener through the first opening in the edge surface and causing the end portion of the fastener to engage the first connector of the locking member and causing the second insert portion of the handle to simultaneously engage the second connector and thereby secure the second insert portion of the handle to the locking member to retain the handle in an installed position on the refrigerator door.

2. The method of claim 1, including:

securing the locking member to the front sheet with the first connector in registry with the first opening.

3. The method of claim 2, wherein:

the locking member is adhesively secured to the front sheet.

4. The method of claim 2, wherein:

the locking member includes at least one protrusion, and including:

positioning the at least one protrusion in the second opening to align the second connector with the second opening.

5. The method of claim 2, including:

filling at least one portion of the interior space of the refrigerator door with foam insulation that at least partially encapsulates the locking member.

6. The method of claim 5, wherein:

the locking member includes a body and at least two side flaps extending away from the body; and including:

encapsulating the side flaps with foam insulation whereby the foam insulation prevents movement of the locking member.

7. The method of claim 1, wherein:

the second insert portion of the handle comprises a protrusion having an axis, the protrusion defining a recessed portion facing transverse to the axis; and including:

causing the end portion of the fastener to engage the recessed portion.

8. The method of claim 7, wherein:

the fastener is threaded;

the first connector of the locking member comprises a threaded opening; and including:

causing the fastener to threadably engage the threaded opening.

9. The method of claim 8, wherein:

the second connector of the locking member comprises a bore, and including:

inserting the protrusion of the handle into the bore.

10. A method of assembling a handle to a refrigerator door, the method comprising:

providing a refrigerator door having a liner and a front sheet that is spaced from the liner to define an interior space, the door including an outwardly facing edge surface extending transversely from the front sheet, the edge surface having a first opening, the front sheet having an inner surface facing the interior space, an oppositely facing outer surface, and second and third openings through the front sheet;

providing a locking member having a first connector comprising a threaded opening and a second connector comprising a bore;

positioning the locking member in the interior space with the threaded opening in registry with the first opening, and the bore in registry with the second opening;

providing a handle having a first and second opposite ends, the first end having a first insert portion, the second end having a second insert portion comprising a protrusion having an axis, the protrusion defining a recessed portion facing transverse to the axis, wherein the protrusion has a circular cross sectional shape, and the recessed portion is defined by adjacent conical surface portions of the protrusion that form an annular groove therebetween;

inserting the first insert portion of the handle into the third opening in the front sheet;

inserting the protrusion into the second opening in the front sheet and inserting the protrusion into the bore of the locking member;

inserting a threaded fastener through the first opening in the edge surface and causing the threaded fastener to threadably engage the threaded opening of the locking member;

causing an end portion of the fastener to engage the recessed portion to thereby secure the protrusion of the handle to the locking member to retain the handle in an installed position on the refrigerator door.

11. The method of claim 1, wherein:

the first end of the handle includes an end surface that engages the outer surface of the front sheet adjacent the third opening when the handle is in the installed position;

the first insert portion comprises a protrusion having a base portion extending from the end surface into the third opening when the handle is in the installed position, the protrusion including a second portion extending transversely from the base portion and engaging the inner surface of the front sheet adjacent the third opening when the handle is in the installed position; and wherein:

during assembly, the first insert portion is inserted into the third opening, followed by rotation of the handle to insert the second insert portion of the handle into the second opening in the front sheet.

12. The method of claim 1, wherein:

the outwardly facing edge surface of the door comprises an upper surface that faces upwardly when the refrigerator door is attached to a refrigerator cabinet.

13. The method of claim 12, including:

providing a door cap, wherein the first opening is in the door cap;

installing the door cap to the liner and the front sheet.

14. A method of assembling a handle to a refrigerator door, the method comprising:

providing a refrigerator door having an interior space and a forwardly-facing outer surface and upper and lower openings through the forwardly-facing outer surface;

providing a locking member having first and second connectors;

positioning the locking member in the interior space with the first connector in registry with the upper opening;

providing a handle having upper and lower opposite ends, the upper end having an upper insert portion including adjacent conical portions forming an annular groove therebetween, the lower end having a lower insert portion;

inserting the lower insert portion of the handle into the lower opening in the forwardly-facing outer surface;

rotating the upper end of the handle upwardly and inwardly to insert the upper insert portion into the upper opening and engaging the upper insert portion with the second connector of the locking member;

causing a fastener to engage the first connector of the locking member and the annular groove of the upper insert portion of the handle to thereby secure the upper insert portion of the handle to the locking member to retain the handle in an installed position on the refrigerator door.

15. The method of claim 1, wherein:

the refrigerator door includes a front sheet having an inner surface that faces the interior space; and including:

securing the locking member to the front sheet with the first connector in registry with the first opening.

16. The method of claim 2, wherein:

the locking member is adhesively secured to the inner surface of the front sheet.

17. The method of claim 15, wherein:

the upper and lower openings are formed in the front sheet;

the locking member includes at least one protrusion, and including:

positioning the protrusion in the upper opening to align the first connector with the first opening.

* * * * *